US008243111B2

(12) United States Patent
Yamasaki et al.

(10) Patent No.: US 8,243,111 B2
(45) Date of Patent: Aug. 14, 2012

(54) OPTICAL DISC LABEL PRINTER, THERMOSENSITIVE RECORDING PRINTER AND THERMOSENSITIVE RECORDING METHOD

(75) Inventors: Fumitomo Yamasaki, Nara (JP); Joji Anzai, Osaka (JP); Naohiro Kimura, Kyoto (JP); Takashi Nishihara, Osaka (JP)

(73) Assignee: Panasonic Corporation, Osaka (JP)

( * ) Notice: Subject to any disclaimer, the term of this patent is extended or adjusted under 35 U.S.C. 154(b) by 292 days.

(21) Appl. No.: 12/597,305

(22) PCT Filed: Apr. 21, 2008

(86) PCT No.: PCT/JP2008/001041

§ 371 (c)(1),
(2), (4) Date: Oct. 23, 2009

(87) PCT Pub. No.: WO2008/139691

PCT Pub. Date: Nov. 20, 2008

(65) Prior Publication Data

US 2010/0128102 A1 May 27, 2010

(30) Foreign Application Priority Data

Apr. 26, 2007 (JP) ..... 2007-117156

(51) Int. Cl.
*B41J 2/47* (2006.01)

(52) U.S. Cl. ..... 347/132; 347/237; 347/247

(58) Field of Classification Search ..... 347/132, 347/224, 225, 247, 237
See application file for complete search history.

(56) References Cited

U.S. PATENT DOCUMENTS

| | | | | |
|---|---|---|---|---|
| 6,862,033 | B2 | 3/2005 | McClellan | |
| 7,545,399 | B2 * | 6/2009 | Inoue et al. | 347/131 |
| 2001/0013889 | A1 * | 8/2001 | Hayashi et al. | 347/243 |
| 2004/0160510 | A1 | 8/2004 | McClellan | |
| 2004/0246330 | A1 * | 12/2004 | Hayashi et al. | 347/243 |
| 2006/0028935 | A1 | 2/2006 | Mori et al. | |
| 2007/0146848 | A1 * | 6/2007 | Fujita et al. | 359/204 |

(Continued)

FOREIGN PATENT DOCUMENTS

| | | |
|---|---|---|
| JP | 6-106761 | 4/1994 |
| JP | 2001-191564 | 7/2001 |

(Continued)

OTHER PUBLICATIONS

International Search Report issued Jul. 29, 2008 in International (PCT) Application No. PCT/JP2008/001041.

*Primary Examiner* — Huan H. Tran
(74) *Attorney, Agent, or Firm* — Wenderoth, Lind & Ponack, L.L.P.

(57) ABSTRACT

A thermosensitive recording printer is provided with semiconductor lasers 1*a* to 1*c*, a polygon mirror 7 for condensing laser light emitted from the semiconductor laser 1*a* to 1*c* as condensed spots on a recording medium 10 to perform scanning in a main scanning direction, and a control unit 9 for controlling the output of the laser light. If a ratio of a spot diameter D1 of the condensed spots in the main scanning direction and a spot diameter D2 in a sub scanning direction satisfy a relationship of D1/D2≦½ at the time of forming an image composed of a plurality of pixels on the recording medium 10 using laser light, high-speed thermosensitive recording and a recording method with an uncomplicated power control are realized without reducing the power density of the condensed spots.

5 Claims, 14 Drawing Sheets

U.S. PATENT DOCUMENTS

2007/0166077 A1* 7/2007 Inoue et al. ..... 399/227

FOREIGN PATENT DOCUMENTS

| | | |
|---|---|---|
| JP | 2004-227641 | 8/2004 |
| JP | 2004-247038 | 9/2004 |
| JP | 2005-49550 | 2/2005 |
| JP | 2005-235359 | 9/2005 |
| JP | 2006-172550 | 6/2006 |
| JP | 2006-236460 | 9/2006 |
| JP | 2007-95269 | 4/2007 |

* cited by examiner

OPTICAL DISC LABEL PRINTER, THERMOSENSITIVE RECORDING PRINTER AND THERMOSENSITIVE RECORDING METHOD

This is a U.S. national stage application under 35 USC 371 of international application PCT/JP2008/001041, filed on Apr. 21, 2008

FIELD OF THE INVENTION

The present invention relates to an optical disc label printer, a thermosensitive recording printer and a thermosensitive recording method for thermally recording an image or the like by irradiating a thermosensitive recording material with laser light.

BACKGROUND ART

Printers for thermally recording an image or the like by giving thermal energy to a thermosensitive recording material have been developed. Particularly, printers capable of high-speed recording by using laser light as a heat source have been proposed. Further, thermosensitive recording materials including color formers, developers and light-absorbing dyes on a substrate and producing colors at a density corresponding to given thermal energy have been developed as those capable of recording good images with high quality. A printer for recording an image or the like on such a thermosensitive recording material is constructed to record a specified image by irradiating the thermosensitive recording material with laser light modulated based on an image signal.

For example, a conventional printer is known from patent literature 1. The conventional thermosensitive recording printer disclosed in patent literature 1 records an image or the like by giving specified thermal energy to a thermosensitive recording material by irradiating the thermosensitive recording material with laser light.

A control unit, an optical unit and a power supply are arranged in the above printer and power is supplied from the power supply to the control unit and the optical unit. The optical unit is controlled by the control unit in accordance with a predetermined program. Further, in the thermosensitive recording material, an information recording layer is formed on a substrate. This information recording layer is made of a material including color formers, developers and light-absorbing dyes for absorbing laser light and converting it into thermal energy.

FIG. 15 is a perspective view showing a schematic construction of the optical unit of the above conventional printer. As shown in FIG. 15, the optical unit 30 is provided with a light source 34 such as a semiconductor laser, a face tangle error correction lens 36 for causing laser light L emitted from the light source 34 to be incident on a polygon mirror 38, a long mirror 44 on which the laser light L reflected by the polygon mirror 38 is incident via a face tangle error correction lens 40 and a lens 46 for condensing the laser light L reflected by the long mirror 44. These elements are arranged in a housing 48.

The polygon mirror 38 is rotated by a motor 50 and the long mirror 44 is pivoted by a galvanometer 52, whereby the laser light L emitted from the light source 34 is scanned in a main scanning direction MS by the rotation of the polygon mirror 38 while being scanned in a sub scanning direction SS by pivotal movements of the long mirror 44.

Next, the operation of the printer constructed as above is described. The laser light L emitted from the light source 34 passes through the face tangle error correction lens 36 to be incident on the polygon mirror 38. The laser light L is scanned in the main scanning direction MS by the rotation of the polygon mirror 38, passes through the face tangle error correction lens 40 and is scanned in the sub scanning direction SS by pivotal movements of the long mirror 44. The laser light L reflected by the long mirror 44 forms circular condensed spots on a thermosensitive recording material 60 via the lens 46. The laser light L is so modulated as to record a specified gradation image by main scanning and sub scanning, and a specified gradation image is recorded on an information recording layer of the thermosensitive recording material 60 to which specified thermal energy is given by the laser light L.

In recent years, with the rapid spread of digital still cameras and the like, it has become general that individuals print photographed digital images at home or the like. At this time, it is demanded to more conveniently print by shortening a recording time (printing time).

Accordingly, in a conventional thermosensitive recording printer for scanning circular condensed spots by laser light in a main scanning direction of a thermosensitive recording material using a polygon mirror or the like to record by thermal energy as described above, speed in the main scanning direction is restricted, for example, by the rotating speed (e.g. a maximum of about 20,000 rpm) of a motor for rotating the polygon mirror. On the other hand, speed in the sub scanning direction is restricted by the feeding pitch of the condensed spots.

FIGS. 16 and 17 are diagrams showing a problem of circular condensed spots in the conventional printer. In FIGS. 16 and 17, a horizontal axis represents the main scanning direction MS and the vertical axis represents the sub scanning direction SS. As shown in FIGS. 16 and 17, in order to increase a feeding pitch P1 in the sub scanning direction SS to be equal to a feeding pitch P2 (P1<P2), condensed spots S1 of laser light condensed on the thermosensitive recording material have to be enlarged to condensed spots S2 (S1<S2) so that no region (region not scanned with the condensed spots) where recording is not performed by the feeding is produced.

However, if the condensed spots are enlarged as shown in FIG. 17, the power density of the condensed spots S2 formed on the thermosensitive recording material decreases. Thus, if the speed in the main scanning direction MS is constant and the recording sensitivity of the thermosensitive recording material is constant, the output of the light source such as a semiconductor laser has to be increased in order to make thermal energy per unit time given to the thermosensitive recording material constant, wherefore there are problems such as a power consumption increase and a cost increase.

Even if the condensed spots are enlarged, a reduction in the power density of the condensed spots formed on the thermosensitive recording material can be covered, for example, by recording the condensed spots even between pixels in an overlapping manner. FIGS. 18A and 18B are diagrams showing a state of condensed spots in the case of recording condensed spots in an overlapping manner during thermosensitive recording in the conventional printer.

Even if power density W1 of condensed spots is not sufficient when condensed spots CS are not recorded in an overlapping manner as shown in FIG. 18A, power density W2 of the condensed spots increases to increase thermal energy per unit time given to the thermosensitive recording material by scanning the thermosensitive recording material while overlapping the condensed spots CS as shown in FIG. 18B. However, in order to record a gradation image based on a specified image signal while overlapping the condensed spots CS between the pixels, the laser light needs to be modulated in consideration of the overlap of the condensed spots before and after the pixels, thereby presenting a problem of making a control very complicated.

Patent Literature 1: Japanese Unexamined Patent Publication No. H06-106761

DISCLOSURE OF THE INVENTION

An object of the present invention is to provide inexpensive and high-performance optical disc label printer and thermosensitive recording printer by realizing high-speed thermosensitive recording and a recording method with an uncomplicated power control without reducing the power density of a condensed spot.

One aspect of the present invention is directed to an optical disc label printer for forming an image composed of a plurality of pixels on an optical disc using laser light, comprising a laser light source; an objective lens for condensing laser light emitted from the laser light source as condensed spots on the optical disc; and a control unit for controlling the output of the laser light, wherein a spot diameter D1 of the condensed spots in an information track direction of the optical disc and a spot diameter D2 of the condensed spots in a radial direction of the optical disc satisfy a relationship of D1/D2≦½.

Another aspect of the present invention is directed to a thermosensitive recording printer for forming an image composed of a plurality of pixels on a recording medium using laser light, comprising a laser light source; a scanning unit for condensing laser light emitted from the laser light source as condensed spots on the recording medium to perform scanning in a main scanning direction; and a control unit for controlling the output of the laser light, wherein a spot diameter D1 of the condensed spots in the main scanning direction and a spot diameter D2 of the condensed spots in a sub scanning direction satisfy a relationship of D1/D2≦½.

Still another aspect of the present invention is directed to a thermosensitive recording method for forming an image composed of a plurality of pixels on a recording medium using laser light, comprising the steps of condensing laser light emitted from a laser light source as condensed spots on the recording medium to perform scanning in a specified scanning direction; and conveying the recording medium in a feeding direction orthogonal to the scanning direction, wherein a spot diameter D1 of the condensed spots in the scanning direction and a spot diameter D2 of the condensed spots in the feeding direction satisfy a relationship of D1/D2≦½.

According to the present invention, it is possible to realize high-speed thermosensitive recording and a recording method with an uncomplicated power control without reducing the power density of condensed spots. Therefore, it is possible to provide inexpensive and high-performance optical disc label printer and thermosensitive recording printer.

BEST MODES FOR EMBODYING THE INVENTION

Hereinafter, embodiments of the present invention are described with reference to the drawings.

First Embodiment

Figure 1:
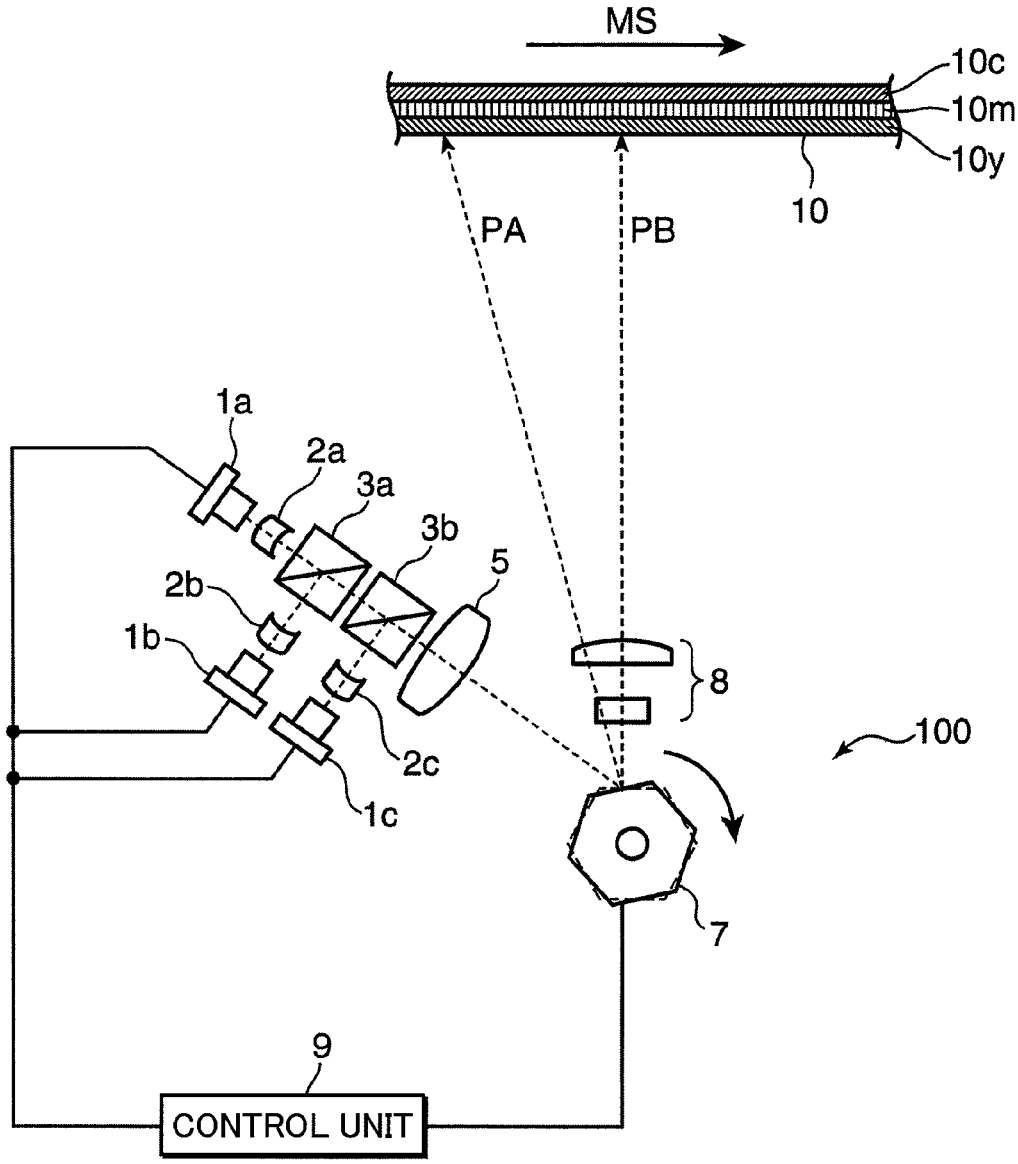
FIG. 1 is a schematic construction diagram of a thermosensitive recording printer according to a first embodiment of the invention.

FIG. 1 is a schematic construction diagram of an optical unit 100 of a thermosensitive recording printer according to a first embodiment of the present invention. The optical unit 100 shown in FIG. 1 is provided with three semiconductor lasers 1*a* to 1*c* as laser light sources, three beam shaping lenses 2*a* to 2*c*, two dichroic prisms 3*a*, 3*b*, a collimator lens 5, a polygon mirror 7, an fθ lens 8 and a control unit 9. By this optical unit 100, light from the light sources is modulated in conformity with an image composed of a plurality of pixels, and the modulated light is scanned and irradiated to a recording medium to record the image on the recording medium 10. Since the construction of a known thermosensitive recording printer can be used as the construction other than the optical unit 100 of the thermosensitive recording printer of this embodiment, such a construction is neither shown nor described.

The semiconductor lasers 1*a* to 1*c* emit beams of laser light having different wavelengths. For example, the semiconductor laser 1*a* emits infrared laser light having a wavelength of 860 nm, the semiconductor laser 1*b* emits infrared laser light having a wavelength of 785 nm and the semiconductor laser 1*c* emits red laser light having a wavelength of 650 nm. The semiconductor lasers 1*a* to 1*c* preferably have outputs thereof precisely controlled by an auto-power control (APC), for example, by performing front light detection using a front monitor (not shown).

The beams of laser light emitted from the semiconductor lasers 1*a* to 1*c* and having different wavelengths are shaped by the beam shaping lenses 2*a* to 2*c* as beam shaping elements, and the optical axes of the respective beams of laser light are caused to coincide by the dichroic prisms 3*a*, 3*b* for selectively transmitting or reflecting the laser light according to the wavelength of the laser light.

The beam shaping lenses 2*a* to 2*c* also have an effect of canceling out aberrations (chromatic aberrations) produced by wavelengths generated by the collimator lens 5 and the fθ lens 8 to be described later. Also in the case of a semiconductor laser as an integral unit of two or all of the semiconductor lasers 1*a* to 1*c* and having a plurality of wavelengths, it is preferable to correct aberrations (chromatic aberrations) produced due to wavelength differences in the middle of an optical path.

The beams of laser light with the matching optical axes are incident on the collimator lens 5 to be converted into substantially parallel light, which is then incident on the polygon mirror 7. The polygon mirror 7 is rotated in a direction of arrow shown in FIG. 1 to scan the three beams of laser light in a main scanning direction MS. For example, the laser light is located at a scanning position PA when the polygon mirror 7 is at a rotational position shown by solid line while being located at a scanning position PB when the polygon mirror 7 is at a rotational position shown by broken line.

The hexagonal polygon mirror 7 repeatedly moves a condensed spot formed by converging the laser light in an arrow direction (main scanning direction) MS on the recording medium 10 six times per rotation, thereby forming scanning lines. The recording medium 10 is continuously conveyed at a constant speed in a sub scanning direction (direction perpendicular to the plane of FIG. 1) by a known conveying mechanism (not shown). A conveying speed is a speed of conveying one scanning line for each beam scanning, i.e. a speed corresponding to a pitch of six scanning lines per rotation of the polygon mirror 7.

The fθ lens 8 converges the laser light at each scanning position reflected by the polygon mirror 7 to form a condensed spot on the recording medium 10. For example, the fθ lens 8 has a face tangle error correction function of satisfactorily maintaining a fθ characteristic for establishing the following relational expression and reducing pitch unevenness caused by face tangle errors of the reflecting surfaces of the polygon mirror 7 when a focal length f=127.5 mm, an angle of deflection θ in the main scanning direction=±20° and h denotes the scanning position.

$$h=f\theta \tag{1}$$

The control unit 9 includes a control circuit for changing the outputs of the semiconductor lasers 1*a* to 1*c* at a high speed in synchronism with the rotating speed of the polygon mirror 7. In one main scanning corresponding to one surface of the polygon mirror 7, the control unit 9 causes the semiconductor lasers 1*a* to 1*c* to simultaneously emit pulses a number of times corresponding to the number of pixels on the scanning line. Drive current values of the semiconductor lasers 1*a* to 1*c* in each pulse emission correspond to CMY density values of the pixel at the position scanned by the condensed spot at that moment and are controlled, for example, in 256 levels.

The recording medium 10 includes a plurality of thermosensitive recording layers 10*c*, 10*m* and 10*y* laminated one over another. These plurality of thermosensitive recording layers 10*c*, 10*m* and 10*y* include thermosensitive color forming compositions for forming colors by heat and photothermal conversion materials for generating heat by absorbing light in different wavelength regions. The first, second and third thermosensitive recording layers are respectively capable of gradation expression of cyan (C), magenta (M) and yellow (Y) by being irradiated with beams of light in different wavelength regions.

Here, out of the plurality of thermosensitive recording layers 10*c*, 10*m* and 10*y* laminated in the recording medium 10, for example, the first thermosensitive recording layer 10*c* is a thermosensitive recording layer for forming cyan by infrared laser light having a wavelength of 860 nm, the second thermosensitive recording layer 10*m* is the one for forming magenta by infrared laser light having a wavelength of 785 nm, and the third thermosensitive recording layer 10*y* is the one for forming yellow by red laser light having a wavelength of 650 nm.

As described above, the cyan of the first thermosensitive recording layer 10*c* is expressed in 256 levels by controlling the semiconductor laser 1*a*, the magenta of the second thermosensitive recording layer 10*m* is expressed in 256 levels by controlling the semiconductor laser 1*b* and the yellow of the third thermosensitive recording layer 10*y* is expressed in 256 levels by controlling the semiconductor laser 1*c*. As a result, full color expression of about 16 million colors is possible.

Various optical elements employed in conventional thermosensitive recording printers for scanning laser light using the polygon mirror 7 may be added or replaced in the optical unit 100. For example, a first focus may be formed at a surface position of the polygon mirror 7 by another focusing lens, laser light reflected by the polygon mirror 7 may be converted into parallel lens by another lens and a condensed spot may be formed on the recording medium 10 by another fθ lens.

Means for deflecting and scanning the beam in the main scanning direction is not limited to the polygon mirror 7. For example, a galvanometer mirror may be arranged instead of the polygon mirror 7 and main scanning may be performed by pivotal movements of the galvanometer mirror instead of main scanning by the rotation of the polygon mirror 7.

Figure 2:
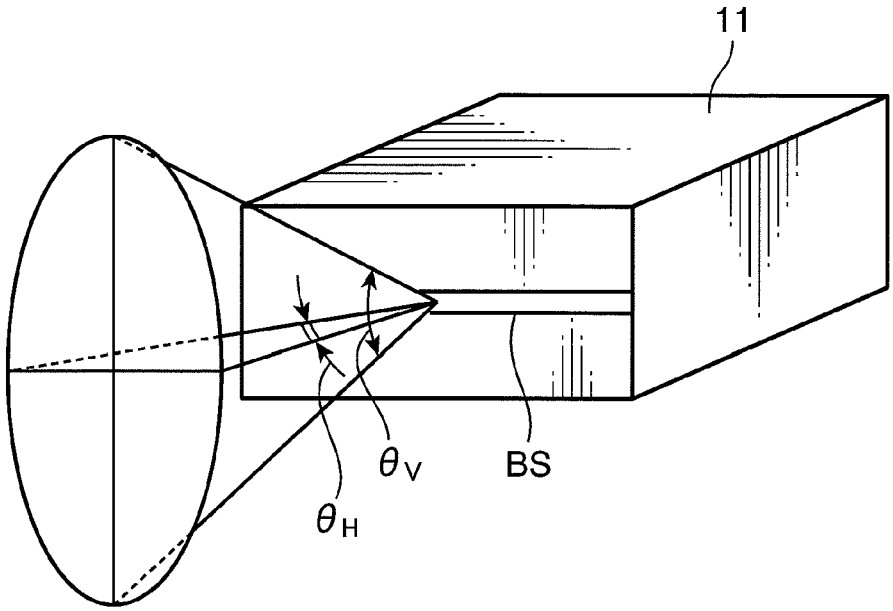
FIG. 2 is a view diagrammatically showing a state of a radiation angle of a semiconductor laser chip.

Next, the shape of the condensed spots of the thermosensitive recording printer constructed as above is described in more detail. A general semiconductor laser chip has an elliptical intensity distribution. As a shown in FIG. 2, a radiation angle $\theta_H$ in a horizontal direction with respect to a bonded surface BS of the semiconductor laser chip 11 is set to about 10° and a radiation angle $\theta_V$ in a vertical direction is set to about 20° as radiation angles (full width half maximums) at a position where peak intensity in the center of the intensity distribution is reduced to ½, wherein the radiation angle $\theta_H$ in the horizontal direction is about half the radiation angle $\theta_V$ in the vertical direction.

Figure 3:
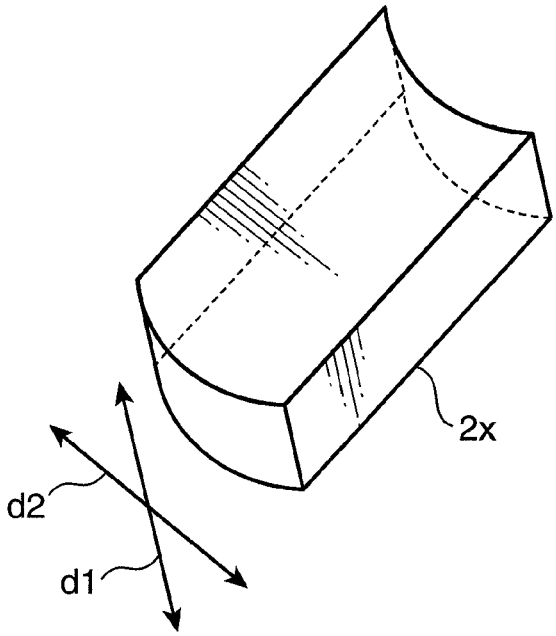
FIG. 3 is a perspective view of a beam shaping lens used in an optical head for optical disc.
Figure 4:
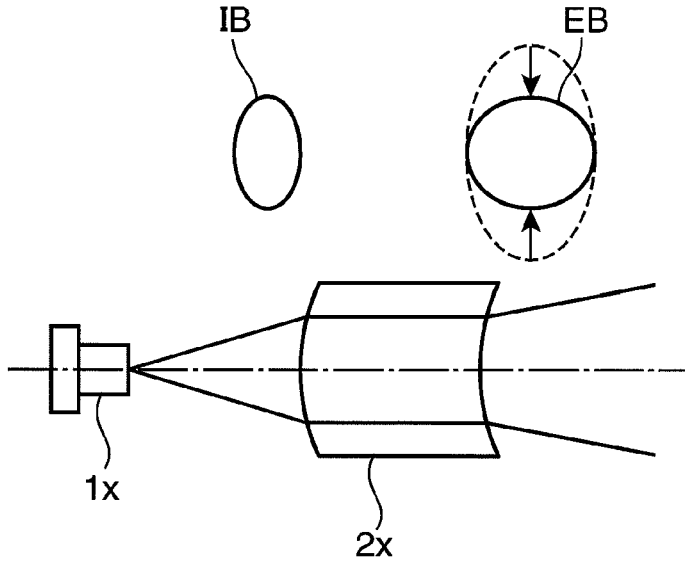
FIG. 4 is a perspective view showing a function of the beam shaping lens shown in FIG. 3.

Here, a beam shaping lens 2*x* used in an optical head for recording and reproduction of an information recording medium such as an optical disc has, for example, a shape as shown in FIG. 3 and reduces a beam diameter only in a direction d2 of two orthogonal axial directions d1, d2 by giving a lens action only in one axial direction d2. Accordingly, a semiconductor laser 1*x* is so arranged with respect to the beam shaping lens 2*x* that a bonded surface of the semiconductor laser 1*x* is parallel to the direction free from the lens action of the beam shaping lens 2*x*. When laser light is emitted from the semiconductor laser 1*x* to be incident on the beam shaping lens 2*x*, the beam shaping lens 2*x* reduces the radiation angle of the transmitting laser light in the vertical direction as shown in FIG. 4, whereby the incident laser light emerges while having the elliptical intensity distribution thereof converted into a substantially circular intensity distribution. As a result, an elliptical incident beam IB is converted into a circular emergent beam EB by the beam shaping lens 2*x*.

Figure 5:
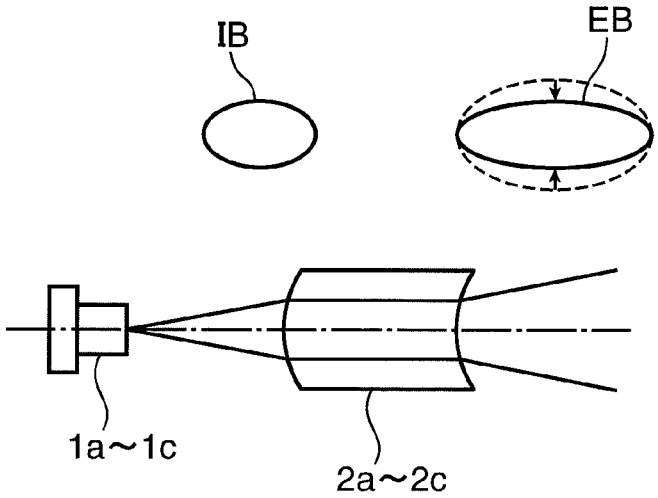
FIG. 5 is a diagram showing a function of a beam shaping lens of the thermosensitive recording printer shown in FIG. 1, FIGS. 6A and 6B are diagrams showing an effect of elliptical condensed spots used in the thermosensitive recording printer shown in FIG. 1, FIGS. 7A and 7B are diagrams showing another effect of the elliptical condensed spots used in the thermosensitive recording printer shown in FIG. 1, FIGS. 8A and 8B are diagrams showing still another effect of the elliptical condensed spots used in the thermosensitive recording printer shown in FIG. 1, FIGS. 9A to 9C are diagrams showing an output adjustment method by trial writing in the thermosensitive recording printer shown in FIG. 1, FIGS. 10A and 10B are diagrams showing a gradation expression by a combination of a pulse width control and a laser output control in the thermosensitive recording printer shown in FIG. 1.

On the other hand, in this embodiment, the semiconductor lasers 1*a* to 1*c* include semiconductor laser chips similar to the above semiconductor laser chip 11, and the beam shaping lenses 2*a* to 2*c* function to convert intensity distributions of beams of laser light emitted from the semiconductor lasers 1*a* to 1*c* into the following intensity distributions. For example, as shown in FIG. 5, the semiconductor lasers 1*a* to 1*c* are so arranged with respect to the beam shaping lenses 2*a* to 2*c* that bonded surfaces thereof are parallel to directions of the beam shaping lenses 2*a* to 2*c* where the lens action is displayed, and beams of laser light are emitted from the semiconductor lasers 1*a* to 1*c* to be incident on the beam shaping lenses 2*a* to 2*c*.

At this time, the beam shaping lenses 2*a* to 2*c* further reduce divergent angles of the transmitting beams of laser light in the horizontal direction while leaving divergent angles in the vertical direction as they area. As a result, emergent beams EB with elliptical intensity distributions having larger aspect ratios than incident beams IB are obtained. The beam shaping lenses 2*a* to 2*c* are arranged before the collimator lens 5 and used for divergent beams. In this way, ratios of diameters of the ellipses in major axis directions to those in minor axis directions are made larger in the emergent beams EB than in the incident beams IB. Thus, using the beam shaping lenses in the divergent beams, the optical system can be miniaturized.

As described above, the recording medium 10 is scanned with condensed spots having an elliptical intensity distribution by focusing laser light having such an intensity distribution with a large aspect ratio, e.g. (dimension in horizontal direction:dimension in vertical direction), i.e. (diameter in the minor axis direction of the ellipse of the emergent beam EB: diameter in the major axis direction of the ellipse of the emergent beam EB)=(1:4) on the recording medium 10 by the fθ lens 8.

As described above, in this embodiment, the semiconductor lasers 1*a* to 1*c* are optically arranged such that a direction perpendicular to the bonded surfaces of the semiconductor lasers 1*a* to 1*c* is aligned with the sub scanning direction and a direction parallel to the bonded surfaces is aligned with the main scanning direction, and beams of light emerging from the beam shaping lenses 2*a* to 2*c* have an aspect ratio of 1:4 as described above. Thus, D1/D2=¼ if a spot diameter of the condensed spots on the recording medium 10 in the main scanning direction is D1 and that in the sub scanning direction is D2.

Figure 6A:
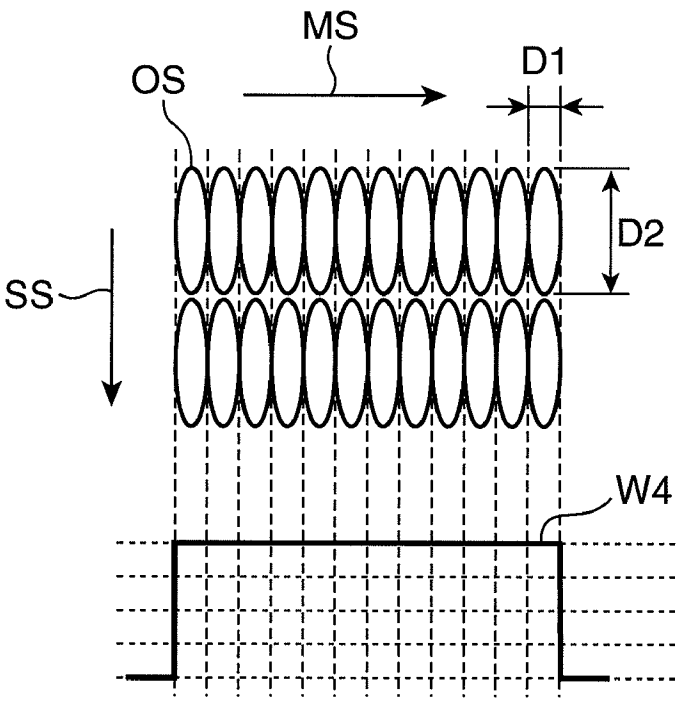

Next, the effect of the condensed spots having the elliptical intensity distribution is described in detail. As shown in FIG. 6A, a full width half maximum (FWHM) D1 of a spot diameter of elliptical condensed spots OS of this embodiment in the main scanning direction MS is 20 μm and a FWHM D2 thereof in the sub scanning direction SS is 80 μm. Power density (energy density) W4 of these condensed spots OS is about four times higher than power density W1 of circular condensed spots CS (FWHM of the diameter is 80 μm) of FIG. 6B shown as a comparative example.

Figure 6B:
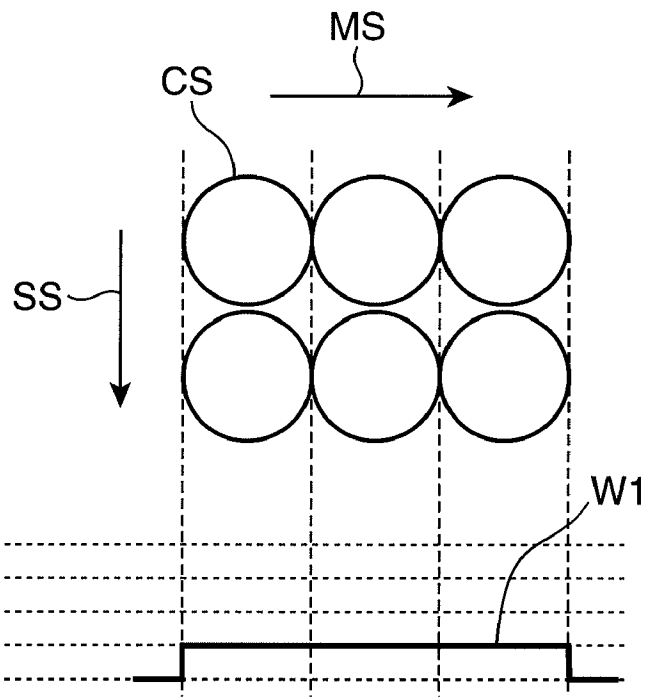

In the case of recording on the recording medium 10 using these condensed spots, the circular condensed spots CS of FIG. 6B require four times higher laser outputs than the elliptical condensed spots OS of FIG. 6A of this embodiment in order to obtain gradation of about the same density for recording media 10 having the same sensitivity. In other words, by using the elliptical condensed spots OS of FIG. 6A of this embodiment, the outputs of the semiconductor lasers 1*a* to 1*c* can be reduced to ¼, whereby effects of reducing power consumption and reducing cost can be obtained.

Figure 7B:
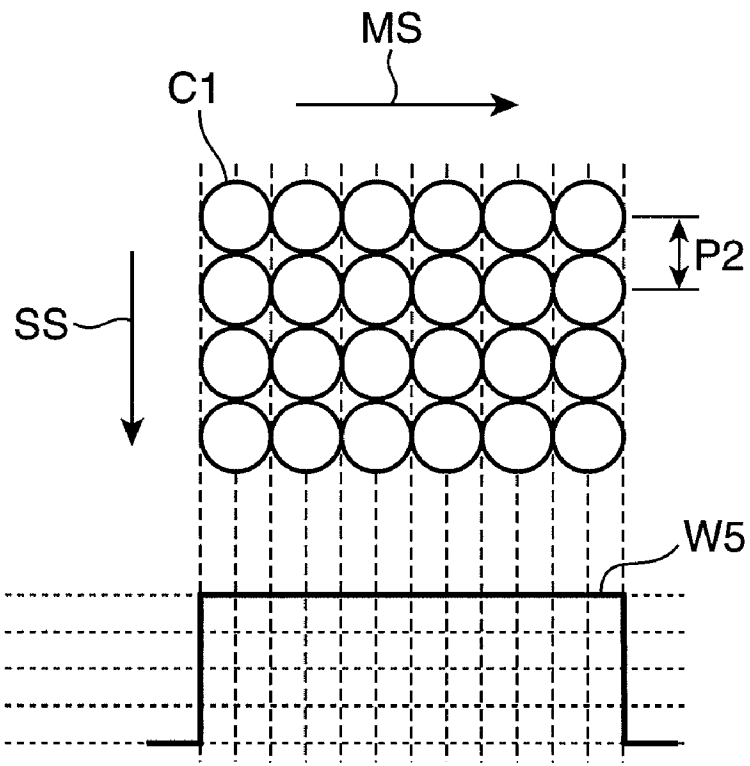
Figure 7A:
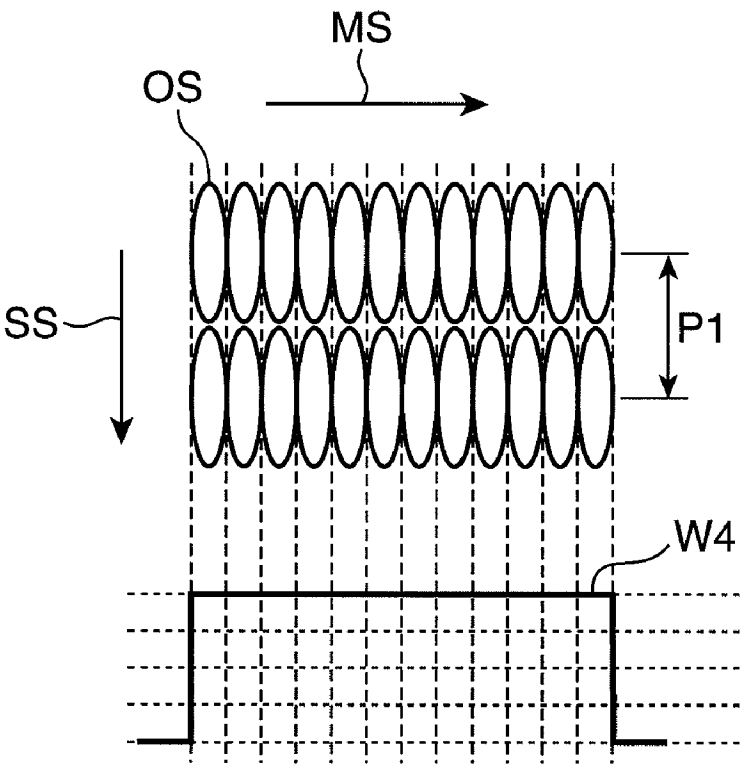

In comparison of the elliptical condensed spots OS of this embodiment as shown in FIG. 7A, and circular condensed spots C1 having an FWHM of the diameter of 40 μm and shown in FIG. 7B, W4=W5 and power densities are equal. However, in the case of using the elliptical condensed spots OS of this embodiment, the feeding pitch P1 in the sub scanning direction SS is twice as large as the feeding pitch P2 of the circular condensed spots C1. Thus, in this embodiment, the number of sub scannings is reduced to ½ and a printing time can be halved if the speed in the main scanning direction restricted by the rotating speed of the polygon mirror 7 is constant.

Figure 8B:
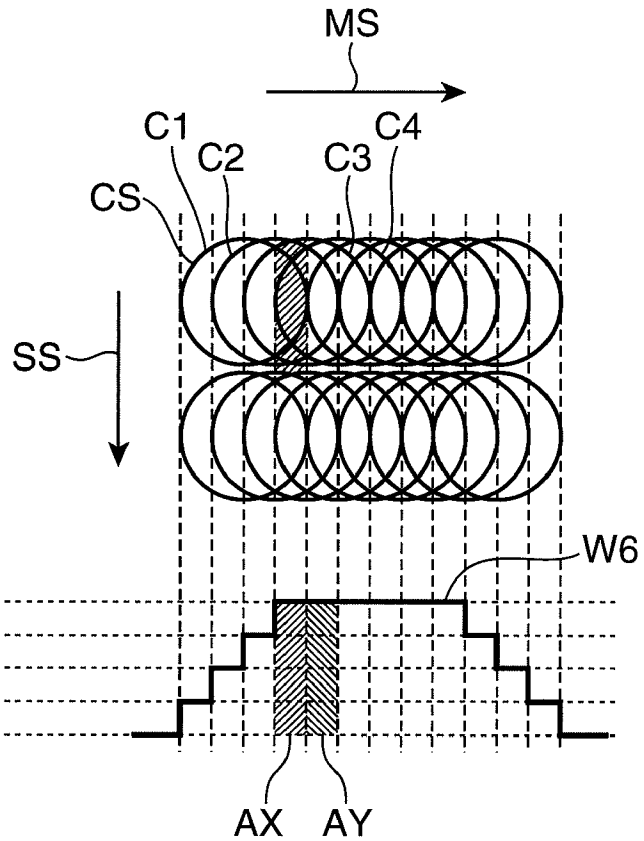
Figure 8A:
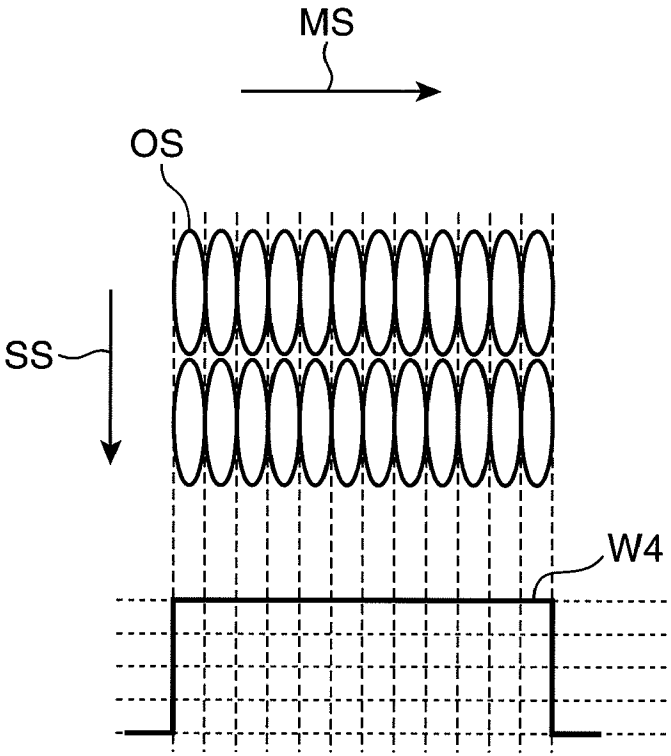

Further, by using circular condensed spots CS having an FWHM of the diameter of 80 μm and performing recording on the recording medium 10 while overlapping condensed spots CS even between the pixels as shown in FIG. 8B, power density W6 per unit time of irradiation to the recording medium 10 becomes equal to the power density W4 of the elliptical condensed spots OS of this embodiment shown in FIG. 8A.

However, in order to make, for example, a region AX of FIG. 8B have a specified density on the recording medium 10, outputs corresponding to four front and rear condensed spots C1 to C4 in FIG. 8B have to be properly controlled and these controlled output values have to be optimal values to make a region AY belonging to an adjacent pixel have a specified density. In other words, in order to perform recording while overlapping the condensed spots even between the pixels as shown in FIG. 8B, the outputs of the semiconductor lasers as the laser light sources have to be controlled in consideration of the influence of the pixel to be recorded on the front and rear pixels, wherefore a very complicated control is necessary.

On the other hand, with the elliptical condensed spots OS of this embodiment shown in FIG. 8A, the outputs of the semiconductor lasers 1*a* to 1*c* as the laser light sources may be set to control values corresponding to the respective density values of CMY in a specified pixel. Thus, desired density values can be realized by a simple control.

In FIGS. 6A, 7A and 8A, the elliptical condensed spots are shown to be arrayed as they are in order to describe the effect of the elliptical condensed spots. Of course, since the spot positions move in the main scanning direction, the spot diameters in the main scanning direction can be changed depending on the emission times of the semiconductor lasers 1*a* to 1*c*. Even in this case, by employing such a construction as to make the laser light have an elliptical intensity distribution in a stationary state, it remains unchanged that the feeding pitch in the sub scanning direction can be increased without increasing the outputs of the semiconductor lasers.

In order to obtain the above effect, the ratio of the spot diameter D1 of the condensed spots in the main scanning direction to the spot diameter D2 in the sub scanning direction is preferably D1/D2≦½, more preferably D1/D2≦⅓ and even more preferably D1/D2≦¼. For example, if D1/D2=¼ and the FWHM of the condensed spots OS in the sub scanning direction SS is 80 μm, the resolution of the thermosensitive recording printer of this embodiment is equivalent to 300 dpi and a full color print result necessary and sufficient as a picture image quality can be obtained by expressing the density values of CMY in each pixel in 256 gradation levels.

The thermosensitive recording printer of this embodiment expresses gradation in the respective thermosensitive recording layers 10*c*, 10*m* and 10*y* of the recording medium 10 by controlling the outputs of the semiconductor lasers 1*a* to 1*c* as the laser light sources. Here, if, for example, ambient temperature is low and the temperature of the recording medium 10 itself is low, thermal energies (i.e. outputs of the semiconductor lasers 1*a* to 1*c*) given to the thermosensitive recording layers 10*c*, 10*m* and 10*y* need to be larger than in the case where ambient temperature is high.

Accordingly, the thermal energies given to the thermosensitive recording layers 10*c*, 10*m* and 10*m* to obtain the specified density values are not necessarily constant due to the ambient temperature and the temperature of the recording medium 10. Thus, the control unit 9 preferably detects the ambient temperature and/or the temperature of the recording medium 10 using a temperature sensor and regulates the outputs of the semiconductor lasers 1*a* to 1*c* according to the detected temperature(s).

Alternatively, it is possible to perform so-called "trial writing" in a specified region of the recording medium 10 and regulate the outputs of the semiconductor lasers 1*a* to 1*c* by reading the densities obtained as a result of the "trial writing" using CCDs or the like. This region where the "trial writing" is performed can be a peripheral region different from a printing region of the recording medium 10.

Figures 9A, 9B, 9C:
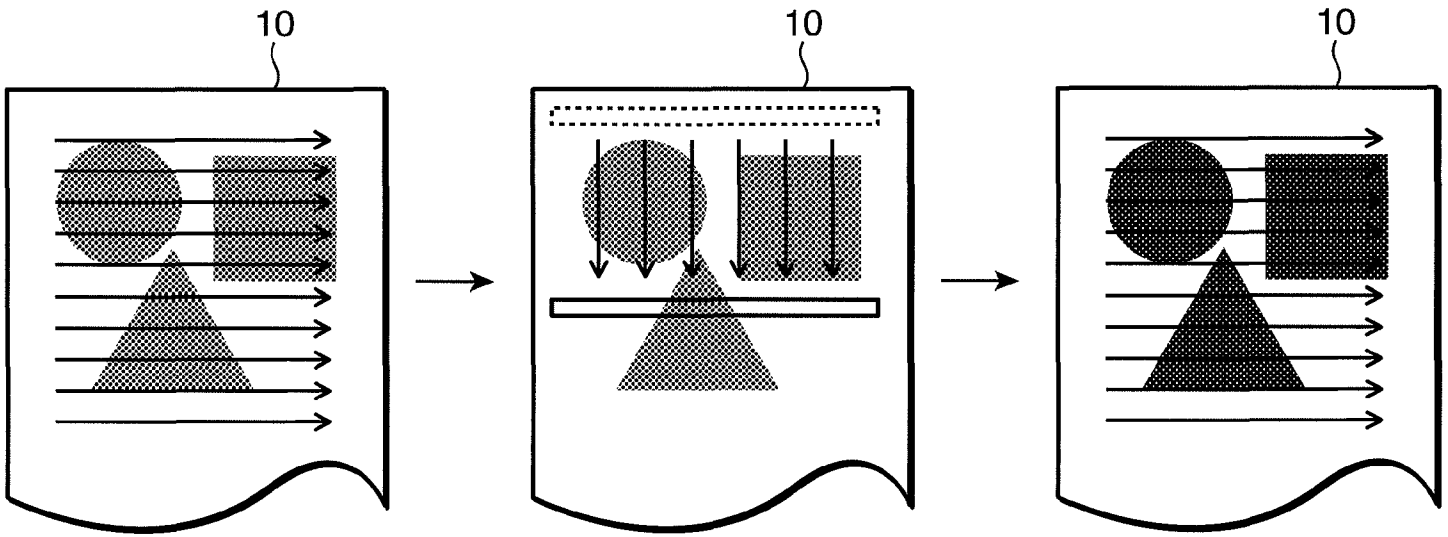

For example, it is also possible to use a "trial writing" technique as shown in FIGS. 9A to 9C. First of all, as shown in FIG. 9A, "trial writing" is performed in a specified region of the printing region of the recording medium 10 with outputs of about 1/10 to ½ of estimated laser light outputs. Subsequently, as shown in FIG. 9B, the obtained densities are read by CCDs or the like. Subsequently, as shown in FIG. 9C, the outputs of the semiconductor lasers 1*a* to 1*c* are regulated according to the densities read by the CCDs or the like, and "overwriting" is performed at the same positions where the "trial writing" was performed to obtain original densities. In this case, output regulation by the "trial writing" which does not require the above peripheral region and can also be applied to so-called borderless printing can be realized.

Figure 10A:
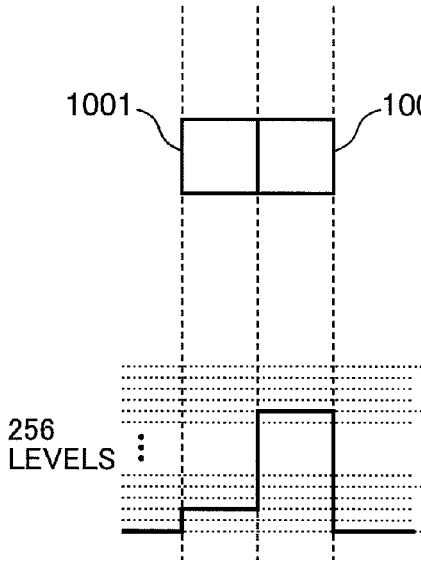

In this embodiment, gradation expression is also possible by adjusting the emission times of the semiconductor lasers 1*a* to 1*c* within a period corresponding to a one-dot pitch. In other words, in the above embodiment, in order to control the thermal energies to be given to the thermosensitive recording layers 10*c*, 10*m* and 10*y* in 256 levels for each pixel for the expression of the cyan, magenta and yellow densities values of each pixel in 256 gradation levels, the outputs of the semiconductor lasers 1*a* to 1*c* during pulse emission corresponding to each pixel are controlled in 256 levels as shown in FIG. 10A. In an example shown in FIG. 10A, the outputs of the semiconductor lasers 1*a* to 1*c* are smaller in a pixel 1001 than in an adjacent pixel 1002.

Figure 10B:
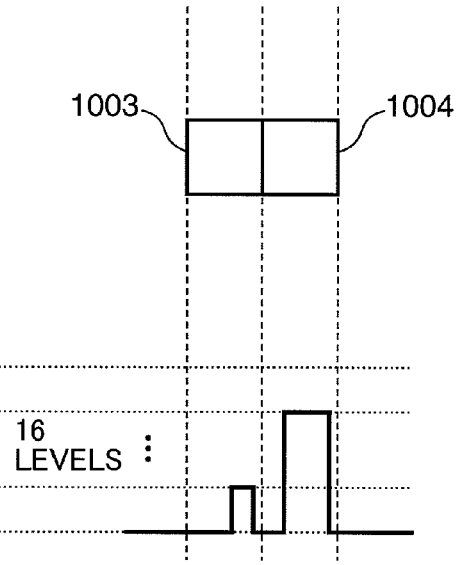

On the other hand, it is also possible to control the thermal energies to be given to the thermosensitive recording layers 10*c*, 10*m* and 10*y* in 256 levels for each pixel, for example, by using a combination of 16 levels of pulse widths shorter than a passage time of each pixel and 16 levels of outputs of the semiconductor lasers 1*a* to 1*c* for each pixel as shown in FIG. 10B. In an example shown in FIG. 10B, in adjacent pixels 1003, 1004, not only the outputs of the semiconductor lasers 1*a* to 1*c*, but also the emission time differ. In the pixel 1003, the outputs of the semiconductor lasers 1*a* to 1*c* are lower and the emission time is shorter than in the adjacent pixel 1004. By combining a pulse width control and a laser output control which have high accuracy in a time axis direction in this way, more accurate gradation expression is possible.

In this embodiment, the beams of laser light are made to have elliptical intensity distributions using the beam shaping lenses 2*a* to 2*c* corresponding to the respective semiconductor lasers 1*a* to 1*c* in order to form the elliptical condensed spots on the recording medium 10. However, it can be similarly performed to make the laser light have an elliptical intensity distribution even if another beam shaping element such as a so-called anamorphic prism is used.

Figure 11:
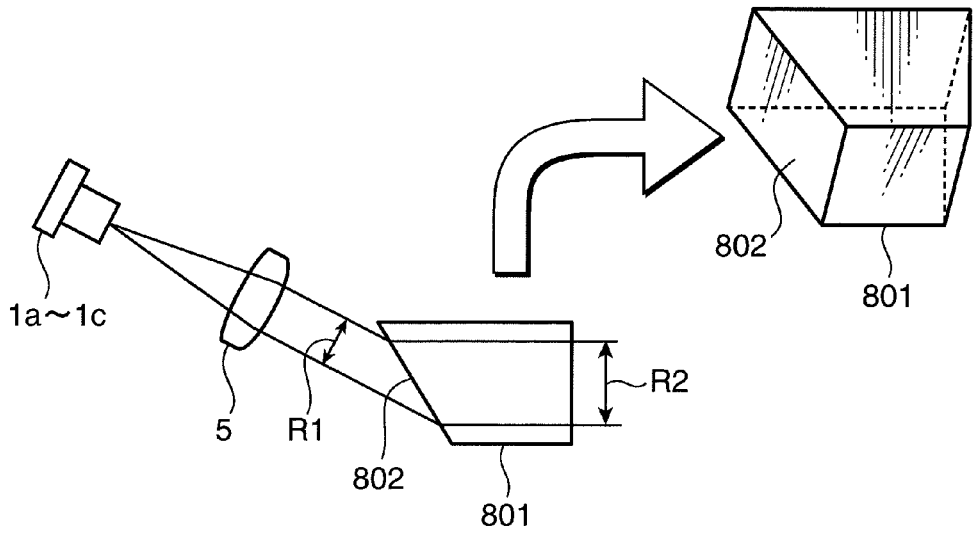
FIG. 11 is a schematic construction diagram showing an optical system in the case of a using an anamorphic prism.

For example, in the case of using an anamorphic prism 801 as shown in FIG. 11, the collimator lens 5 is arranged between the anamorphic prism 801 and the semiconductor lasers 1*a* to 1*c*. Parallel light from the collimator lens 5 is obliquely incident on a prism surface 802 of the anamorphic prism 801. By causing the anamorphic prism 801 to refract and transmit the parallel light in this way, the beam diameter of the laser light only in a vertical direction can be increased from a diameter R1 to a diameter R2, whereby elliptical condensed spots similar to the above can be formed. Although the anamorphic prism 801 is more easily produced than lenses, it needs to be arranged in parallel light, which makes the optical system larger. For the miniaturization of the optical unit, it is preferable to use the beam shaping lenses as shown in this embodiment.

Although the diameter of the laser light in the vertical direction (sub scanning direction) is enlarged in this embodiment, the diameter in the horizontal direction may be reduced in addition to or instead of enlarging the diameter of the laser light in the vertical direction as described above by the beam shaping element without being particularly limited to this example. It is sufficient to make the ratio of the diameter D1 of the condensed spots in the main scanning direction to the diameter D2 thereof in the sub scanning direction on the recording medium 10 equal to or smaller than ½ using the beam shaping element. In this case, the semiconductor lasers 1*a* to 1*c* need not always be arranged such that the direction perpendicular to the bonded surfaces is aligned with the sub scanning direction and the direction parallel thereto is aligned with the main scanning direction. For example, the ratio D1/D2 may be made equal to or smaller than ½ by reducing the diameter of the laser light in the vertical direction while enlarging the diameter thereof in the horizontal direction.

By causing astigmatism in the middle of the optical path of the laser light, the condensed spots on the recording medium 10 can be made to have an elliptical shape. Further, the aspect ratio of the condensed spots on the recording medium 10 is not limited to 1:4. For example, in the case of an aspect ratio of about 1:2, the above beam shaping element becomes unnecessary by arranging the semiconductor lasers so that the vertical directions of the semiconductor lasers are aligned with the sub scanning direction of the recording medium, whereby the optical unit can be further simplified. The above points similarly hold for a second embodiment described below.

Second Embodiment

Figure 12:
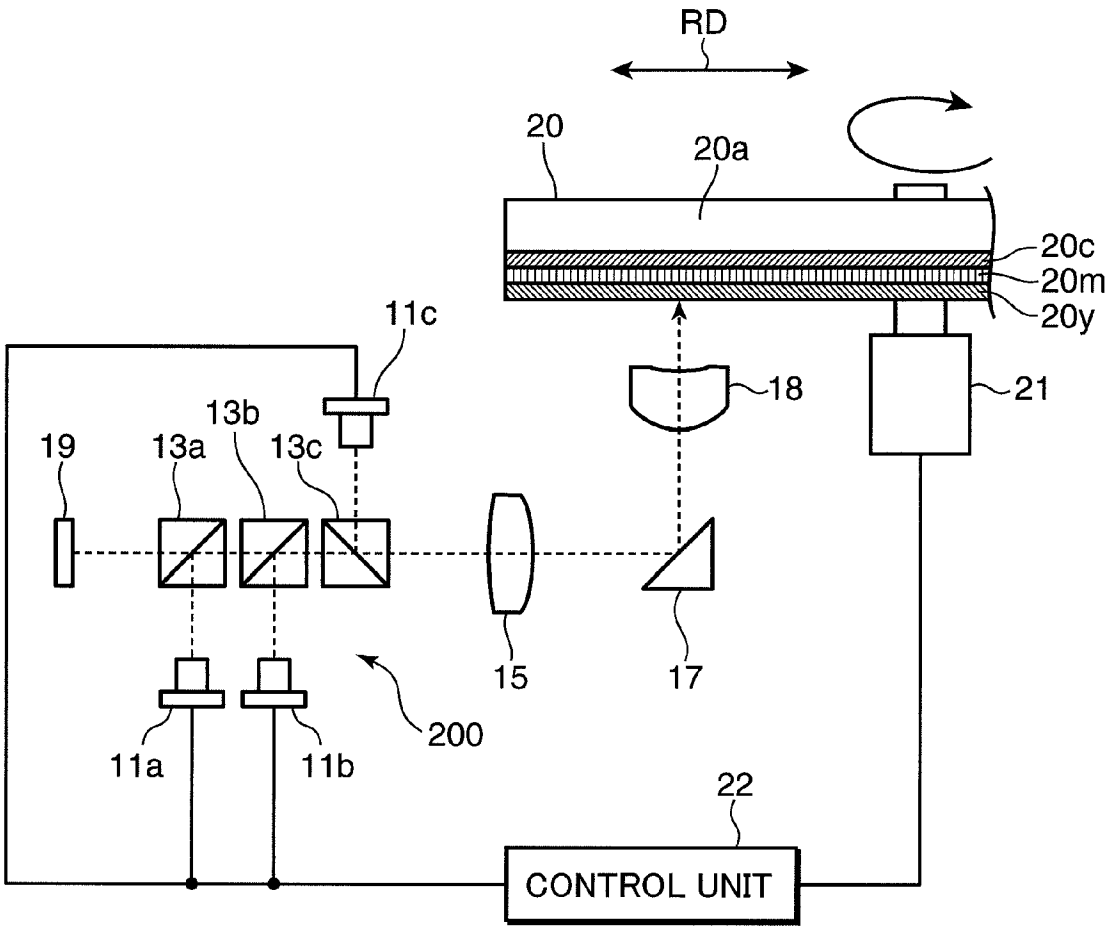
FIG. 12 is a schematic construction diagram of an optical disc label printer according to a second embodiment of the invention.

FIG. 12 is a schematic construction diagram of an optical disc label printer according to a second embodiment of the present invention. The optical disc label printer shown in FIG. 12 is provided with an optical head 200, a spindle motor 21 and a control unit 22, wherein the optical head 200 includes three semiconductor lasers 11*a* to 11*c* as laser light sources, three dichroic beam splitters 13*a* to 13*c*, a collimator lens 15, a reflecting mirror 17, an objective lens 18 and a photodetector 19. Various optical elements employed in conventional optical heads for recording or reproducing information using an objective lens may be added or replaced in the optical head 200.

The optical head 200 of the optical disc label printer of this embodiment can record and/or reproduce information on and/ or from an optical disc 20 such as a CD (Compact Disc), a DVD (Digital Versatile Disc) or a Blu-ray disc similar to an optical head of an ordinary optical disc drive device and can be used as an optical disc label printer for recording arbitrary images and characters such as titles by irradiating a surface of the optical disc 20 opposite to an information recording surface 20*a* with laser light.

Next, the operation of the optical disc label printer is described with reference to FIG. 12. Since an original operation of the optical head 200 for recording or reproducing information on or from an optical disc is the same as that of a general optical head for optical disc, such an operation is not described.

The semiconductor lasers 11*a* to 11*c* emit beams of laser light having different wavelengths. For example, the semiconductor laser 11*a* emits infrared laser light having a wavelength of 785 nm, the semiconductor laser 11*b* emits red laser light having a wavelength of 650 nm and the semiconductor laser 11*c* emits blue-violet laser light of a wavelength of 405 nm, so that information can be recorded on or reproduced from optical discs corresponding to the respective wavelengths.

Here, the optical disc 20 includes a plurality of thermosensitive recording layers 20*c*, 20*m* and 20*y* laminated one over another on the surface opposite to the information recording surface 20*a* where information is recorded or reproduced. By the irradiation of beams in different wavelength regions, the first, second and third thermosensitive recording layers 20*c*, 20*m* and 20*y* are respectively capable of gradation expression of cyan (C), magenta (M) and yellow (Y).

For example, out of the plurality of thermosensitive recording layers 20*c*, 20*m* and 20*y* laminated in the recording medium 20, the first thermosensitive recording layer 20*c* is a thermosensitive recording layer for forming cyan by being irradiated with infrared laser light having a wavelength of 785 nm, the second thermosensitive recording layer 20*m* is the one for forming magenta by being irradiated with red laser light having a wavelength of 650 nm, and the third thermosensitive recording layer 20*y* is the one for forming yellow by being irradiated with blue-violet laser light having a wavelength of 405 nm.

The optical axes of beams of laser light emitted from the semiconductor lasers 11*a* to 11*c* and having different wavelengths are caused to coincide by the dichroic beam splitters 13*a* to 13*c* for selectively transmitting or reflecting the laser light according to the wavelength of the laser light. The beams of laser light with the matching optical axes are incident on the collimator lens 15 to be converted into substantially parallel light, which is then reflected by the reflecting mirror 17 and irradiated to the plurality of thermosensitive recording layers 20*c*, 20*m* and 20*y* laminated on the surface of the optical disc 20 opposite to the information recording surface 20*a* by the objective lens 18. The laser light irradiated to the thermosensitive recording layers 20*c*, 20*m* and 20*y* is largely out of focus (defocus) unlike condensed spots converged to a diffraction limit on the information recording surface 20*a* upon recording or reproducing information.

The photodetector 19 is for receiving the laser light reflected by the information recording surface 20*a* and detecting a servo signal and an information signal upon recording or reproducing information on or from the information recording surface 20*a*, and does not function when the optical head 200 is used as the optical disc label printer.

The optical disc 20 is rotated by the spindle motor 21, and a condensed spot by laser light can be formed at an arbitrary position (pixel) of the optical disc 20 by scanning the entire optical head 200 in a radial direction RD using a transverse motor (not shown).

The control unit 22 causes the semiconductor lasers 11*a* to 11*c* to change outputs thereof at a high speed and perform pulse emissions in correspondence with pixels on the optical disc 20. Drive current values of the semiconductor lasers 11*a* to 11*c* in the respective pulse emissions are controlled, for example, in 8 levels in correspondence with the respective density values of CMY of a pixel where the condensed spot is formed.

As described above, the cyan of the first thermosensitive recording layer 20*c* is expressed in 8 gradation levels by controlling the semiconductor laser 11*a*, the magenta of the second thermosensitive recording layer 20*m* is expressed in 8 gradation levels by controlling the semiconductor laser 11*b* and the yellow of the third thermosensitive recording layer 20*y* is expressed in 8 gradation levels by controlling the semiconductor laser 11*c*. As a result, full color expression of 512 colors is possible.

Figure 13:
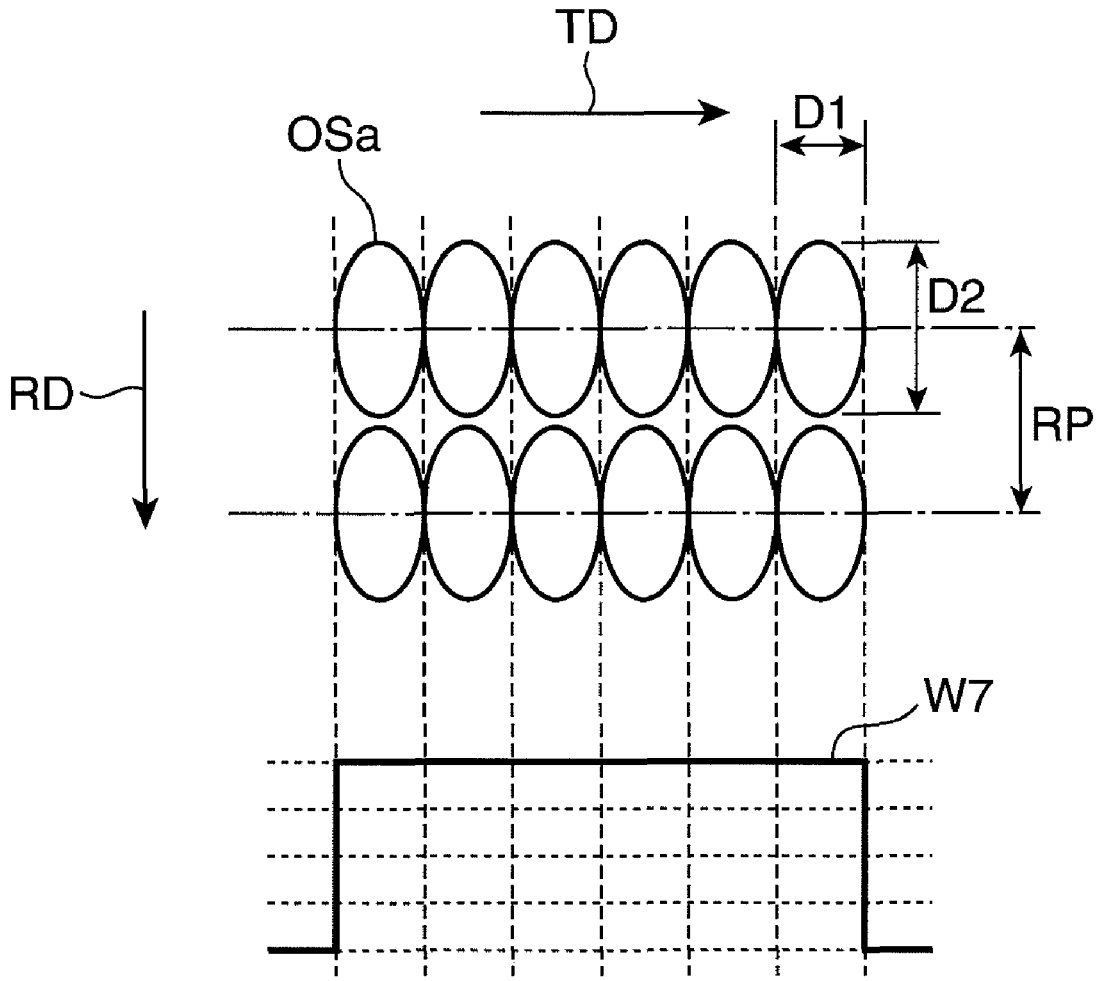
FIG. 13 is a diagram showing a state of elliptical condensed spots used in the optical disc label printer shown in FIG. 12.

Here, in the optical head 200, the semiconductor lasers 11*a* to 11*c* are arranged such that a direction perpendicular to bonded surfaces of the semiconductor lasers 11*a* to 11*c* is aligned with the radial direction Rd of the optical disc. Condensed spots OSa on the optical disc 20 are as shown in FIG. 13 and a ratio of a condensed spot diameter D1 in an information track direction TD of the optical disc 20 to a condensed spot diameter D2 in the radial direction RD of the optical disc 20 can be set to about 1:2. For example, an FWHM D1 of the spot diameter in the information track direction is 40 μm and that D2 in the radial direction RD is 80 μm.

As described above, since the optical head 200 of this embodiment forms the elliptical condensed spots OSa longer in the radial direction RD as shown in FIG. 13, power density W7 is higher as compared with circular condensed spots similar to the first embodiment, wherefore the outputs of the semiconductor lasers 11*a* to 11*c* can be reduced. Further, in the case of using the elliptical condensed spots, a feeding pitch RP in the radial direction RD increases. Thus, if the rotating speed of the optical disc restricted by the rotating speed of the spindle motor 21 is assumed to be constant, the printing time can be halved. Further, as shown in the first embodiment, the outputs of the semiconductor lasers 11*a* to 11*c* as the laser light sources may be set to control values corresponding to the respective density values of CMY in a specified pixel and desired density values can be realized by a simple control.

Although the optical head used to record or reproduce information on or from an optical disc is applied to the optical disc label printer in this embodiment, the present invention is not limited to such an embodiment. For example, the optical head can also be constructed exclusively for an optical disc label printer. In this case, a photodetector becomes unnecessary and the construction is simpler by constructing the optical head exclusively for the optical disc label printer.

Figure 14:
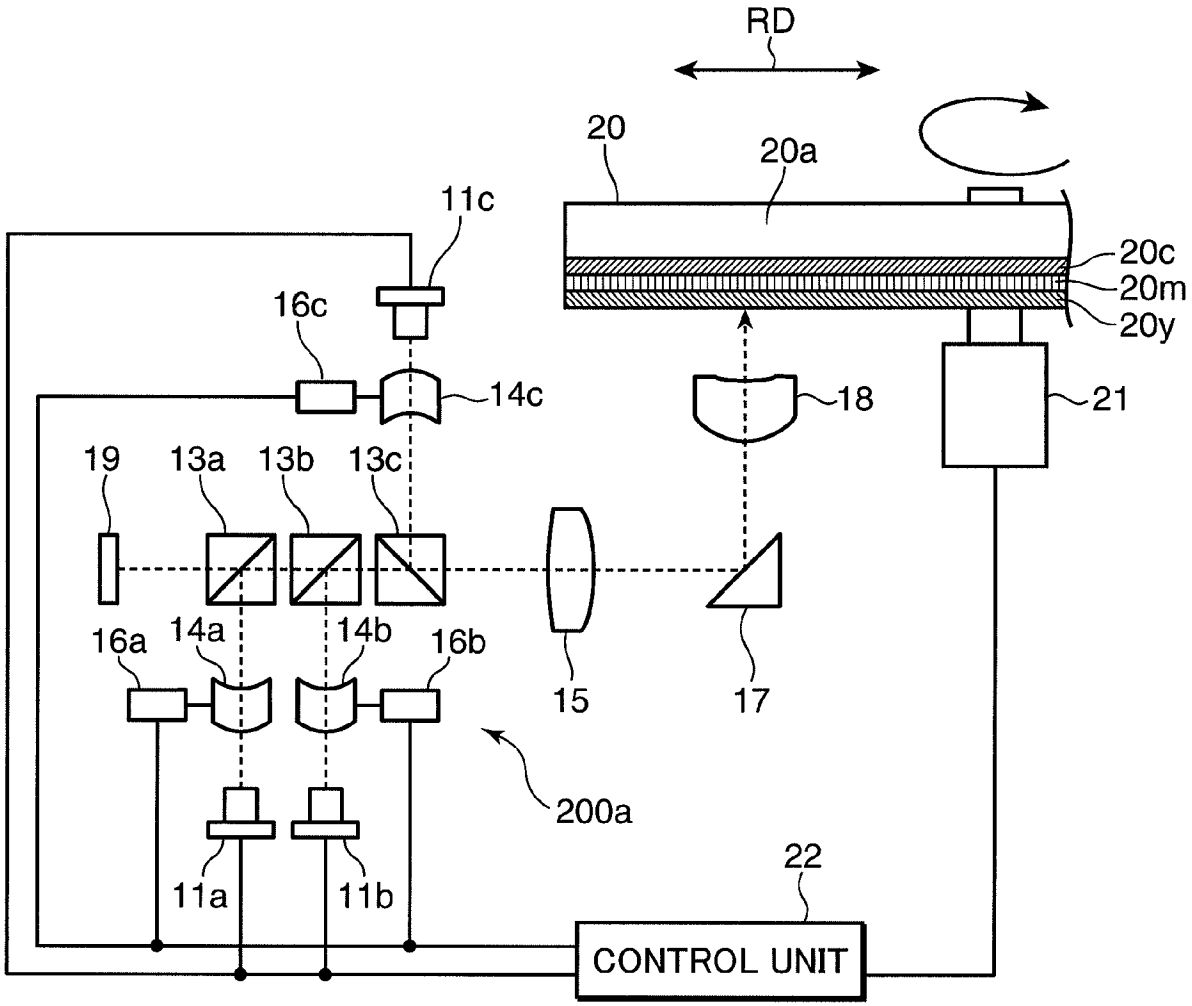
FIG. 14 is a schematic construction diagram of another optical disc label printer according to the second embodiment of the invention.
Figure 15:
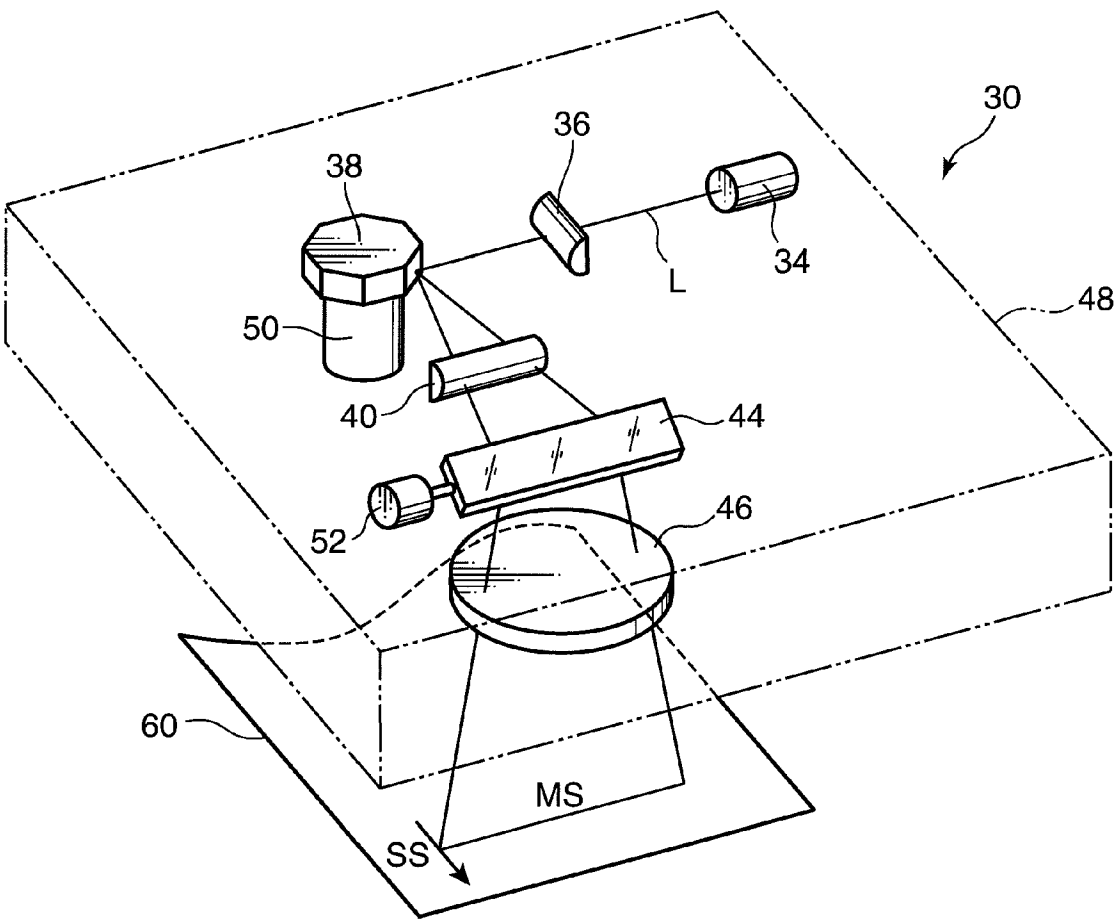
FIG. 15 is a perspective view showing a schematic construction of a conventional thermosensitive recording printer.
Figure 16:
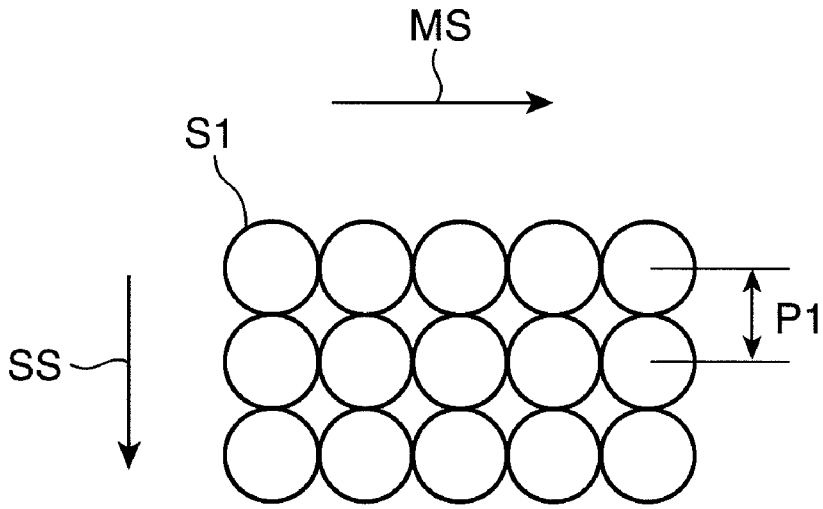
FIG. 16 is a diagram showing a problem of conventional circular condensed spots.
Figure 17:
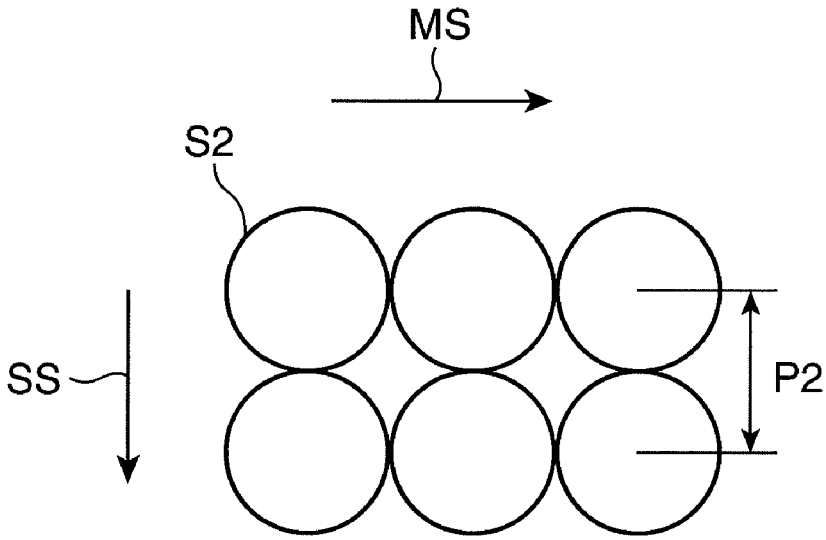
FIG. 17 is a diagram showing the problem of the conventional circular condensed spots.
Figure 18A:
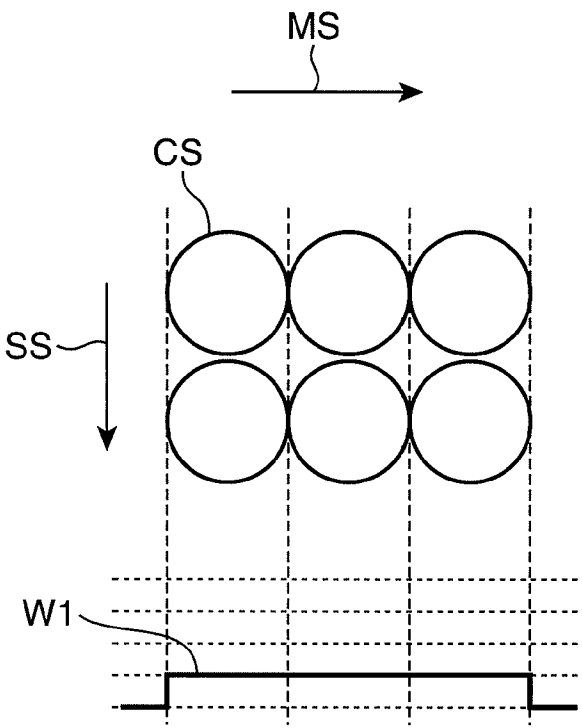
FIGS. 18A and 18B are diagrams showing another problem of the conventional circular condensed spots.
Figure 18B:
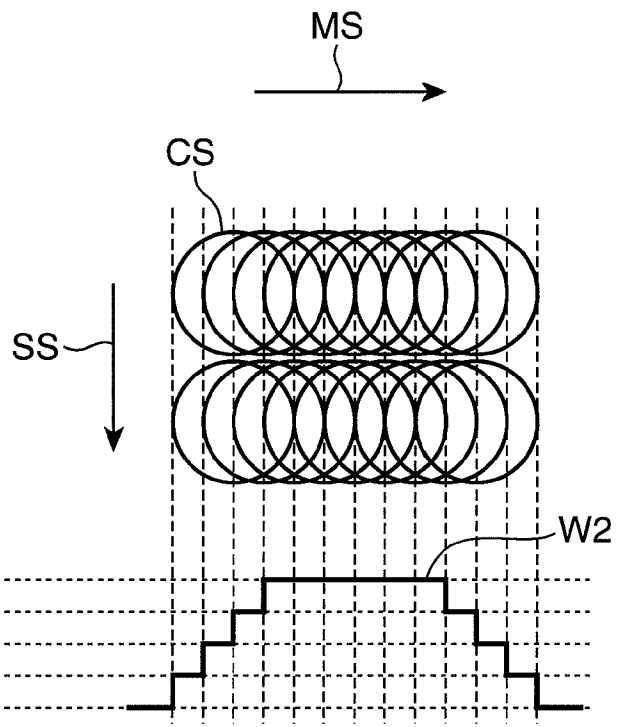

Further, as shown in FIG. 14, the ratio of the condensed spot diameter in the information track direction to the condensed spot diameter in the radial direction may be set, for example, to about 1:4 using an optical head 200*a* added with beam shaping lenses 14*a* to 14*c* similar to the first embodiment.

Specifically, the beam shaping lenses 14*a* to 14*c* are so held by driving mechanisms 16*a* to 16*c* as to be rotatable about the optical axes of beams of laser light, and the control unit 22 controls the driving mechanisms 16*a* to 16*c* to rotate the beam shaping lenses 14*a* to 14*c* upon recording or reproducing information on or from an optical disc 20 using the optical head 200*a*, thereby arranging the beam shaping lenses 14*a* to 14*c* at angles shown in FIG. 14 between the semiconductor lasers 11*a* to 11*c* and the dichroic beam splitters 13*a* to 13*c*.

In this case, the beam shaping lenses 14*a* to 14*c* can convert elliptical beams of laser light emitted from the semiconductor lasers 11*a* to 11*c* into beams of laser light having an elliptical cross section approximate to a circular cross section (preferably circular cross section) and convert the aspect ratio of the laser light from (1:2) into (1:1) as in FIG. 4. Thus, laser light having an elliptical cross section more approximate to a circular cross section and preferably used for recording or reproducing information on or from the optical disc 20, can be generated, and the optical head 200*a* can be used to record or reproduce information on or from the optical disc 20 without being subjected to any unnecessary optical influence of the beam shaping lenses 14*a* to 14*c*.

When the optical head 200*a* is used to form an image composed of a plurality of pixels in the thermosensitive recording layers 20*c*, 20*m* and 20*y* of the optical disc 20, i.e. used for an optical disc label printer, the control unit 22 controls the driving mechanisms 16*a* to 16*c* to rotate the beam shaping lenses 14*a* to 14*c* by 90° from the angles shown in FIG. 14, thereby arranging the beam shaping lenses 14*a* to 14*c* between the semiconductor lasers 11*a* to 11*c* and the dichroic beam splitters 13*a* to 13*c*.

In this case, the beam shaping lenses 14*a* to 14*c* can convert elliptical beams of laser light emitted from the semiconductor lasers 11*a* to 11*c* into flatter elliptical beams of laser light and convert the aspect ratio of the laser light from (1:2) into (1:4) as in FIG. 5. As a result, also the optical disc label printer shown in FIG. 14, the ratio of the condensed spot diameter in the information track direction to the condensed spot diameter in the radial direction can be set to ¼ similar to the first embodiment, wherefore a time required to print a label can be further shortened and the outputs of the semiconductor lasers as the laser light sources can also be further reduced. Various driving mechanisms such as DC motors or ultrasonic motors can be used as the driving mechanisms 16*a* to 16*c*.

The construction for setting the ratio of the condensed spot diameter in the information track direction to the condensed spot diameter in the radial direction to 1:4 using the optical head 200*a* added with the beam shaping lenses 14*a* to 14*c* similar to the first embodiment is not particularly limited to the above example and the following construction may also be employed.

For example, the beam shaping lenses 14*a* to 14*c* are so held by the driving mechanisms 16*a* to 16*c* as to be movable on optical paths and, when the optical head 200*a* is used to form an image composed of a plurality of pixels in the thermosensitive recording layers 20*c*, 20*m* and 20*y* of the optical disc 20, i.e. used for an optical disc label printer, the control unit 22 controls the driving mechanisms 16*a* to 16*c* to arrange the beam shaping lens 14*a* between the semiconductor laser 11*a* and the dichroic beam splitter 13*a*, the beam shaping lens 14*b* between the semiconductor laser 11*b* and the dichroic beam splitter 13*b* and the beam shaping lens 14*c* between the semiconductor laser 11*c* and the dichroic beam splitter 13*c* as shown in FIG. 14.

As a result, even in the optical disc label printer of this example, the ratio of the condensed spot diameter in the information track direction to the condensed spot diameter in the radial direction can be set to ¼ similar to the first embodiment, wherefore a time required to print a label can be further shortened and the outputs of the semiconductor lasers as the laser light sources can also be further reduced. Various driving mechanisms such as swing arm actuators or solenoid actuators can be used as the driving mechanisms 16*a* to 16*c*.

When the optical head 200*a* is used to record or reproduce information on or from the optical disc 20, the control unit 22 controls the driving mechanisms 16*a* to 16*c* to move the beam shaping lens 14*a* from the position between the semiconductor laser 11*a* and the dichroic beam splitter 13*a* and arrange it outside the optical path, to move the beam shaping lens 14*b* from the position between the semiconductor laser 11*b* and the dichroic beam splitter 13*b* and arrange it outside the optical path and to move the beam shaping lens 14*c* from the position between the semiconductor laser 11*c* and the dichroic beam splitter 13*c* and arrange it outside the optical path. As a result, the optical head 200*a* can be used to record or reproduce information on or from the optical disc 20. In this example, means for compensating for optical distances may be suitably provided if optical distances between the semiconductor lasers and the collimator lens and the like change.

In the above respective embodiments, the recording medium 10 and the optical disc 20 include a plurality of thermosensitive recording layers and the respective thermosensitive recording layers are transparent in an initial state and form colors according to given thermal energies. However, the present invention is not limited to such thermosensitive recording layers, and thermosensitive recording layers which are in color in an initial state and whose dyes are decomposed according to given thermal energies can also be employed.

In the case of use for an optical disc label printer as in the second embodiment, the optical disc 20 includes a single thermosensitive recording layer and it is apparent that this single thermosensitive recording layer may be a thermosensitive recording layer which forms color according to given thermal energy or a thermosensitive recording layer whose dye is decomposed according to given thermal energy.

The present invention is summarized as follows from the above respective embodiments. Specifically, an optical disc label printer according to the present invention is for forming an image composed of a plurality of pixels on an optical disc using laser light and comprises a laser light source; an objective lens for condensing laser light emitted from the laser light source as condensed spots on the optical disc; and a control unit for controlling the output of the laser light, wherein a spot diameter D1 of the condensed spots in an information track direction of the optical disc and a spot diameter D2 of the condensed spots in a radial direction of the optical disc satisfy a relationship of $D1/D2 \leqq 1/2$.

Since the ratio of the condensed spot diameter in the information track direction to that in the radial direction is set to or below ½ in this optical disc label printer, it is possible to reduce the output of the laser light source to or below ½ and increase a feeding pitch in the radial direction to twice or more as compared with the case of using circular condensed spots. As a result, it is possible to realize high-speed thermosensitive recording and a recording method with an uncomplicated power control without reducing the power density of the condensed spots, and an inexpensive and high-performance optical disc label printer can be provided.

The above optical disc label printer preferably further comprises a beam shaping element for reducing a full width half maximum of a radiation angle of the laser light having an elliptical cross section and emitted from the laser light source in a direction parallel to a bonded surface of the laser light source and/or increasing a full width half maximum of a radiation angle of the elliptical beam in a direction perpendicular to the bonded surface.

In this case, since the ratio of the condensed spot diameter in the information track direction to that in the radial direction can be further reduced by the beam shaping element, it is possible to realize higher-speed thermosensitive recording and a recording method with an uncomplicated power control without reducing the power density of the condensed spots.

It is preferable that the above optical disc label printer further comprises a driver for rotatably holding the beam shaping element; and that the driver rotates the beam shaping element to convert the laser light having an elliptical cross section and emitted from the laser light source into laser light having a flatter elliptical cross section when an image is formed on the optical disc while rotating the beam shaping element to convert the laser light having an elliptical cross section and emitted from the laser light source into laser light having an elliptical cross section more approximate to a circular cross section when information is recorded on or reproduced from the optical disc.

In this case, the optical disc label printer can also be used as an optical disc drive device to stably record and reproduce information on or from the optical disc without being subjected to any unnecessary optical influence of the beam shaping element.

It is preferable that the above optical disc label printer further comprises a driver for movably holding the beam shaping element; and that the driver causes the beam shaping element to be arranged on an optical path of the laser light from the laser light source when an image is formed on the optical disc while causing the beam shaping element to be arranged outside the optical path of the laser light from the laser light source when information is recorded on or reproduced from the optical disc.

In this case, information can be stably recorded on and reproduced from the optical disc by using the optical disc label printer as an optical disc drive device.

The control unit preferably controls both emission power and emission time of the laser light for one pixel to gradation record an image composed of a plurality of pixels.

In this case, more accurate gradation expression is possible since it is possible to perform a pulse width control with accuracy in a time axis direction and perform an accurate laser output control.

The optical disc preferably includes a plurality of thermosensitive recording layers which are transparent in an initial state and form colors according to thermal energies given by the condensed spots.

In this case, a gradation-recorded good image can be formed on the optical disc since the thermosensitive recording layers can form colors by giving the thermal energies according to the output of the elliptical condensed spots.

It is preferable that the laser light source emits beams of laser light having different wavelengths $\lambda 1$, $\lambda 2$ and $\lambda 3$ ($\lambda 1<\lambda 2<\lambda 3$, unit: nm); that the optical disc includes three thermosensitive recording layers which are transparent in an initial state and form different colors according to thermal energies given by the condensed spots; and that the thermal energies are respectively given to the three thermosensitive recording layers by the condensed spots of the beams of laser light having different wavelengths.

In this case, the three thermosensitive recording layers can form different colors according to the wavelengths of the laser light and can form colors in arbitrary gradation levels by giving the thermal energies according to the outputs of the elliptical condensed spots for the respect wavelengths of the laser light. Thus, a full color image necessary and sufficient as a picture image quality can be formed on the optical disc.

The optical disc may include a thermosensitive recording layer which is in color in an initial state and whose dye is decomposed according to thermal energy given by the condensed spots.

In this case, since the dye of the thermosensitive recording layer can be decomposed by giving the thermal energy according to the output of the elliptical condensed spots, a gradation-recorded good image can be formed on the optical disc.

It is preferable that the laser light source emits beams of laser light having different wavelengths $\lambda 1$, $\lambda 2$ and $\lambda 3$ ($\lambda 1<\lambda 2<\lambda 3$ unit: nm); that the optical disc includes three thermosensitive recording layers which are in different colors in an initial state and whose dyes are decomposed according to thermal energies given by the condensed spots; and that the thermal energies are respectively given to the three thermosensitive recording layers by the condensed spots of the beams of laser light having different wavelengths.

In this case, the different dyes of the three thermosensitive recording layers can be decomposed according to the wavelengths of the laser light and can be decomposed in arbitrary gradation levels by giving the thermal energies according to the outputs of the elliptical condensed spots for the respect wavelengths of the laser light. Thus, a full color image necessary and sufficient as a picture image quality can be formed on the optical disc.

It is preferable that the wavelength $\lambda 1$ satisfies a relationship of 350 nm$<\lambda 1<$450 nm, the wavelength $\lambda 2$ satisfies a relationship of 600 nm$<\lambda 2<$700 nm and the wavelength $\lambda 3$ satisfies a relationship of 750 nm$<\lambda 3<$850 nm.

In this case, since beams of laser light having different wavelengths and suitable for recording or reproducing information on or from the optical disc can be emitted, a good image can be formed on and information can be recorded on and reproduced from optical discs corresponding to the respective wavelengths while optical components are shared.

A thermosensitive recording printer according to the present invention is for forming an image composed of a plurality of pixels on a recording medium using laser light and comprises a laser light source, a scanning unit for condensing laser light emitted from the laser light source as condensed spots on the recording medium to perform scanning in a main scanning direction and a control unit for controlling the output of the laser light, wherein a spot diameter D1 of the condensed spots in the main scanning direction and a spot diameter D2 of the condensed spots in a sub scanning direction satisfy a relationship of $D1/D2 \leqq 1/2$.

Since the ratio of the condensed spot diameter in the main scanning direction to that in the sub scanning direction is set to or below ½ in this thermosensitive recording printer, it is possible to reduce the output of the laser light source to or below ½ and increase a feeding pitch in the sub scanning direction to twice or more as compared with the case of using circular condensed spots. As a result, it is possible to realize high-speed thermosensitive recording and a recording method with an uncomplicated power control without reducing the power density of the condensed spots, and an inexpensive and high-performance thermosensitive recording printer can be provided.

A thermosensitive recording method according to the present invention is for forming an image composed of a plurality of pixels on a recording medium using laser light and comprises the steps of condensing laser light emitted from a laser light source as condensed spots on the recording medium to perform scanning in a specified scanning direction; and conveying the recording medium in a feeding direction orthogonal to the scanning direction, wherein a spot diameter D1 of the condensed spots in the scanning direction and a spot diameter D2 of the condensed spots in the feeding direction satisfy a relationship of D1/D2≦½.

Since the ratio of the condensed spot diameter in the scanning direction to that in the feeding direction is set to or below ½ in this thermosensitive recording method, it is possible to reduce the output of the laser light source to or below ½ and increase a feeding pitch of the recording medium to twice or more as compared with the case of using circular condensed spots. As a result, it is possible to realize high-speed thermosensitive recording and a recording method with an uncomplicated power control without reducing the power density of the condensed spots.

INDUSTRIAL APPLICABILITY

An optical disc label printer or a thermosensitive recording printer according to the present invention can realize high-speed thermosensitive recording and an inexpensive and high-performance recording method with an uncomplicated power control without reducing the power density of condensed spots and is, therefore, useful as an optical disc label printer that also functions as an optical disc drive device, a thermosensitive recording printer for picture or the like.

What is claimed is:

1. A thermosensitive recording printer for forming an image composed of a plurality of pixels on a recording medium using laser light, comprising:

a laser light source;

a scanning unit for condensing laser light emitted from the laser light source as condensed spots on the recording medium to perform scanning in a main scanning direction, a conveying unit for conveying the recording medium in a sub scanning direction orthogonal to the main scanning direction, and a control unit for controlling the output of the laser light, wherein a spot diameter D1 of the condensed spots in the main scanning direction and a spot diameter D2 of the condensed spots in the sub scanning direction satisfy a relationship of D1/D2≦½.

2. A thermosensitive recording printer according to claim 1, wherein the control unit controls both emission power and emission time of the laser light for one pixel to gradation record an image composed of a plurality of pixels.

3. A thermosensitive recording printer according to claim 1, wherein the recording medium includes a plurality of thermosensitive recording layers which are transparent in an initial state and form colors according to thermal energies given by the condensed spots.

4. A thermosensitive recording method for forming an image composed of a plurality of pixels on a recording medium using laser light, comprising the steps of:

condensing laser light emitted from a laser light source as condensed spots on the recording medium to perform scanning in a main scanning direction;

conveying the recording medium in a sub scanning direction orthogonal to the main scanning direction; and controlling the output of the laser light, wherein a spot diameter D1 of the condensed spots in the main scanning direction and a spot diameter D2 of the condensed spots in the sub scanning direction satisfy a relationship of D1/D2≦½.

5. A thermosensitive recording method according to claim 4, wherein the step of controlling the output of the laser light includes the step of gradation-recording an image composed of a plurality of pixels by controlling both emission power and emission time of the laser light for one pixel.

* * * * *